US011202164B2

(12) United States Patent
Merimaa et al.

(10) Patent No.: US 11,202,164 B2
(45) Date of Patent: Dec. 14, 2021

(54) PREDICTIVE HEAD-TRACKED BINAURAL AUDIO RENDERING

(71) Applicant: Apple Inc., Cupertino, CA (US)

(72) Inventors: Juha O. Merimaa, Cupertino, CA (US); Christopher T. Eubank, Cupertino, CA (US); Martin E. Johnson, Los Gatos, CA (US); Stuart J. Wood, San Francisco, CA (US); Deepak Natarajan, Berkeley, CA (US)

(73) Assignee: Apple Inc., Cupertino, CA (US)

( * ) Notice: Subject to any disclaimer, the term of this patent is extended or adjusted under 35 U.S.C. 154(b) by 0 days.

(21) Appl. No.: 16/651,316

(22) PCT Filed: Sep. 25, 2018

(86) PCT No.: PCT/US2018/052646

§ 371 (c)(1),
(2) Date: Mar. 26, 2020

(87) PCT Pub. No.: WO2019/067445

PCT Pub. Date: Apr. 4, 2019

(65) Prior Publication Data

US 2020/0236489 A1 Jul. 23, 2020

Related U.S. Application Data

(60) Provisional application No. 62/564,195, filed on Sep. 27, 2017.

(51) Int. Cl.

| | |
|---|---|
| ***H04R 5/02*** | (2006.01) |
| ***H04S 7/00*** | (2006.01) |
| ***H04R 5/033*** | (2006.01) |

(52) U.S. Cl.

CPC ..... *H04S 7/304* (2013.01); *H04R 5/033* (2013.01); *H04R 2499/15* (2013.01); *H04S 2400/11* (2013.01)

(58) Field of Classification Search

CPC ..... H04R 5/033; H04S 7/304; H04S 2400/11

(Continued)

(56) References Cited

U.S. PATENT DOCUMENTS

| | | | |
|---|---|---|---|
| 2009/0129603 | A1 | 5/2009 | Cho |
| 2017/0045941 | A1 | 2/2017 | Tokubo et al. |

(Continued)

FOREIGN PATENT DOCUMENTS

| | | |
|---|---|---|
| CN | 101816192 | 8/2010 |
| CN | 107211226 | 9/2017 |

(Continued)

OTHER PUBLICATIONS

International Search Report and Written Opinion from PCT/US2018/052646, dated Sep. 25, 2018, pp. 1-14.

(Continued)

*Primary Examiner* — Katherine A Faley
(74) *Attorney, Agent, or Firm* — Robert C. Kowert; Kowert, Hood, Munyon, Rankin & Goetzel, P.C.

(57) ABSTRACT

Methods and apparatus for predictive head-tracked binaural audio rendering in which a rendering device renders multiple audio streams for different possible head locations based on head tracking data received from a headset, for example audio streams for the last known location and one or more predicted or possible locations, and transmits the multiple audio streams to the headset. The headset then selects and plays one of the audio streams that is closest to the actual head location based on current head tracking data. If none of the audio streams closely match the actual head location, two closest audio streams may be mixed. Transmitting multiple audio streams to the headset and selecting or mixing an audio stream on the headset may mitigate or eliminate perceived head tracking latency.

20 Claims, 15 Drawing Sheets

(58) Field of Classification Search
USPC ..... 381/309
See application file for complete search history.

(56) References Cited

U.S. PATENT DOCUMENTS

| | | | | |
|---|---|---|---|---|
| 2017/0188154 | A1 | 6/2017 | Werris | |
| 2017/0295446 | A1* | 10/2017 | Thagadur Shivappa | ..... H04S 3/008 |

FOREIGN PATENT DOCUMENTS

| | | |
|---|---|---|
| CN | 109074238 | 12/2018 |
| WO | 2017176375 | 10/2017 |

OTHER PUBLICATIONS

Office Action and Search from from Chinese Patent Application No. 201880063472.8, dated Dec. 2, 2020 (Partial English Translation & Chinese version), pp. 1-9.

* cited by examiner (WORLD)

PREDICTIVE HEAD-TRACKED BINAURAL AUDIO RENDERING

This application is a 371 of PCT Application No. PCT/US2018/052646, filed Sep. 25, 2018, which claims benefit of priority to U.S. Provisional Patent Application No. 62/564,195, filed Sep. 27, 2017. The above applications are incorporated herein by reference. To the extent that any material in the incorporated application conflicts with material expressly set forth herein, the material expressly set forth herein controls.

BACKGROUND

Virtual reality (VR) allows users to experience and/or interact with an immersive artificial environment, such that the user feels as if they were physically in that environment. For example, virtual reality systems may display stereoscopic scenes to users in order to create an illusion of depth, and a computer may adjust the scene content in real-time to provide the illusion of the user moving within the scene. When the user views images through a virtual reality system, the user may thus feel as if they are moving within the scenes from a first-person point of view. Similarly, mixed reality (MR) combines computer generated information (referred to as virtual content) with real world images or a real world view to augment, or add content to, a user's view of the world, or alternatively combines virtual representations of real world objects with views of a three-dimensional (3D) virtual world. The simulated environments of virtual reality and/or the mixed environments of mixed reality may thus be utilized to provide an interactive user experience for multiple applications.

SUMMARY

Various embodiments of methods and apparatus for predictive head-tracked binaural audio rendering are described. Embodiments of an audio rendering system and audio rendering methods are described that may, for example, be implemented by mobile multipurpose devices such as smartphones, pad devices, and tablet devices that render and transmit head-tracked binaural audio via wireless technology (e.g., Bluetooth) to binaural audio devices (e.g., headphones, earbuds, etc.) worn by the user. Embodiments may also be implemented in VR/AR systems that include a computing device (referred to as a base station) that renders and transmits head-tracked binaural audio via wireless technology to a head-mounted display (HMD) that provides binaural audio output, or to a separate binaural audio device used with a HMD. The device worn by the user that provides binaural audio output (e.g., a HMD, headphones, earbuds, etc.) may be referred to herein as the "headset." The device that renders and transmits audio to the headset may be referred to herein as the "rendering device." The headset may include head tracking technology (e.g., IMUs (inertial measurement units), gyroscopes, attitude sensors, compasses, etc.)

Head-tracked binaural audio rendering is a technique that may be used in applications including but not limited to VR/AR applications to create virtual audio sources that appear stable in the environment regardless of the listener's actual orientation/position. A head-tracked binaural audio rendering method may output a binaural audio stream (including left and right audio channels) to a headset so that the listener hears sounds in a spatial audio sense. In other words, the listener hears sounds as if the sounds were coming from real world locations with accurate distance and direction.

Perceived latency may be a problem in head tracking, rendering, and playing back the audio when responding to head movements. Latency may be a particular problem when the head tracking data and audio are transmitted over a wireless link between the rendering device and the headset, which may add 300 ms or more to the latency. In embodiments, to mitigate the problem with perceived latency, instead of generating a single audio stream based on a predicted head position, the rendering device renders multiple audio streams for multiple different head positions based on the head tracking data, for example audio streams for the last known position and one or more predicted or possible positions, and transmits the audio for these different positions to the headset in multiple audio streams. Metadata may be included with the audio streams that identifies the positions of the different streams. The headset then selects one of the audio streams that is closest to the actual head position based on current head tracking data and the metadata. Selecting an audio stream is a relatively simple and low-cost operation, and thus requires only minimal processing power on the headset. In some embodiments, if none of the audio streams closely match the actual head position, the headset may select two closest audio streams and mix the audio streams. Sending multiple audio streams to the headset and selecting (or mixing) a matching audio stream on the headset may mitigate or eliminate perceived head tracking latency.

In some embodiments, if there is a single virtual audio source, the rendering device may render a single audio stream based on a head position indicated by the head tracking data received from the headset. At the headset, the headset may alter the left and/or right audio channel to adjust the perceived location of the virtual audio source based on the actual position of the user's head determined from current head tracking data, for example by adding delay to the left or right audio channel.

In some embodiments, when multiple audio streams are rendered and transmitted, the rendering device may use a multichannel audio compression technique that leverages similarity in the audio signals to compress the audio signals and thus reduce wireless bandwidth usage.

While embodiments are described in reference to a mobile multipurpose device or a base station connected by wireless technology to a headset or HMD worn by the user, embodiments may also be implemented in other systems, for example in home entertainment systems that render and transmit binaural audio to headsets worn by users via wireless technology. Further, embodiments may also be implemented in systems that use wired rather than wireless technology to transmit binaural audio to headsets. More generally, embodiments may be implemented in any system that includes binaural audio output and that provides head motion and orientation tracking.

Figure 1A:
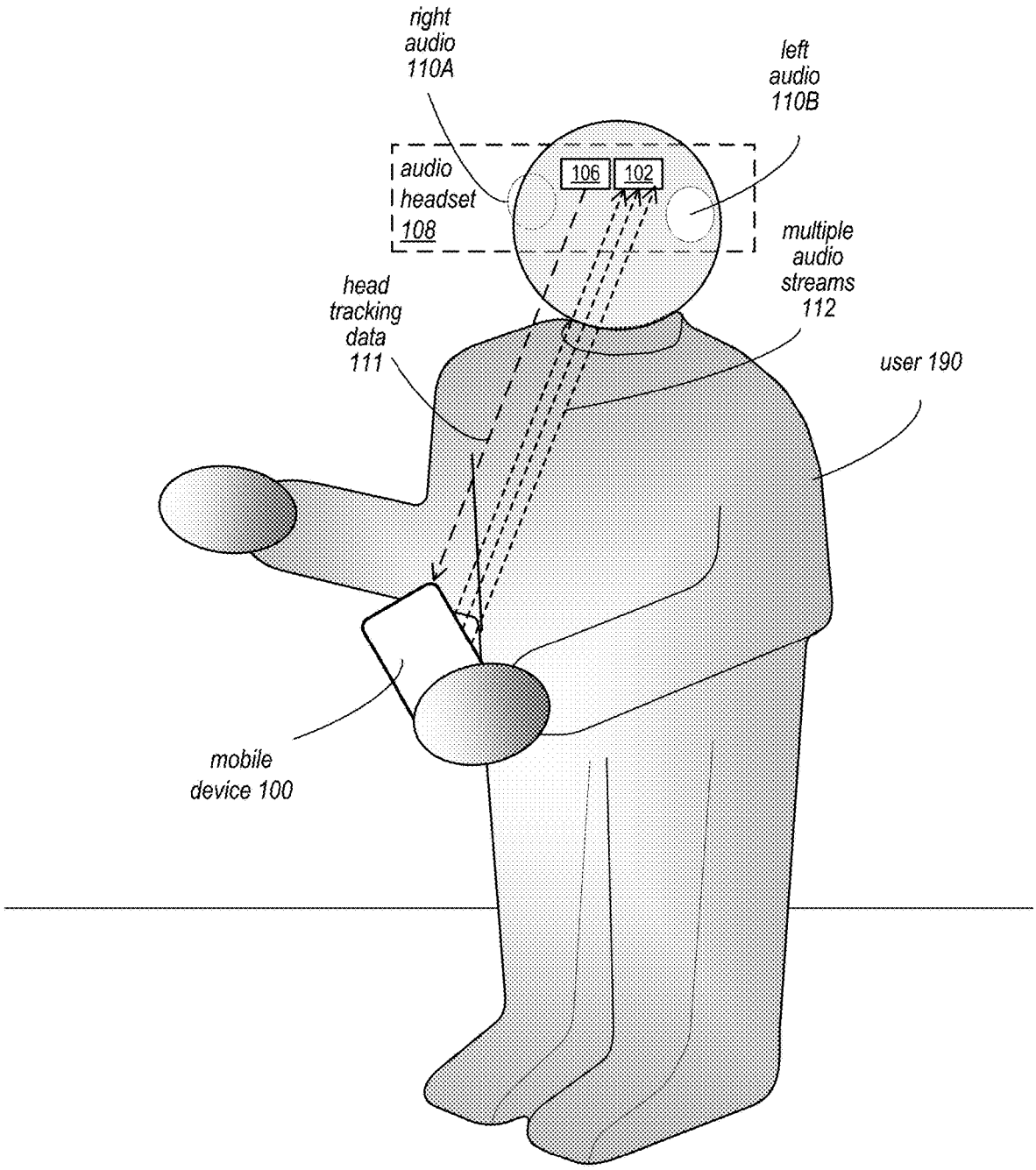
FIGS. 1A and 1B illustrate embodiments of an example mobile multipurpose device that may implement embodiments of the audio rendering methods as described herein.

This specification includes references to "one embodiment" or "an embodiment." The appearances of the phrases "in one embodiment" or "in an embodiment" do not necessarily refer to the same embodiment. Particular features, structures, or characteristics may be combined in any suitable manner consistent with this disclosure.

"Comprising." This term is open-ended. As used in the claims, this term does not foreclose additional structure or steps. Consider a claim that recites: "An apparatus comprising one or more processor units . . . " Such a claim does not foreclose the apparatus from including additional components (e.g., a network interface unit, graphics circuitry, etc.).

"Configured To." Various units, circuits, or other components may be described or claimed as "configured to" perform a task or tasks. In such contexts, "configured to" is used to connote structure by indicating that the units/circuits/components include structure (e.g., circuitry) that performs those task or tasks during operation. As such, the unit/circuit/component can be said to be configured to perform the task even when the specified unit/circuit/component is not currently operational (e.g., is not on). The units/circuits/components used with the "configured to" language include hardware—for example, circuits, memory storing program instructions executable to implement the operation, etc. Reciting that a unit/circuit/component is "configured to" perform one or more tasks is expressly intended not to invoke 35 U.S.C. § 112, paragraph (f), for that unit/circuit/component. Additionally, "configured to" can include generic structure (e.g., generic circuitry) that is manipulated by software or firmware (e.g., an FPGA or a general-purpose processor executing software) to operate in manner that is capable of performing the task(s) at issue. "Configure to" may also include adapting a manufacturing process (e.g., a semiconductor fabrication facility) to fabricate devices (e.g., integrated circuits) that are adapted to implement or perform one or more tasks.

"First," "Second," etc. As used herein, these terms are used as labels for nouns that they precede, and do not imply any type of ordering (e.g., spatial, temporal, logical, etc.). For example, a buffer circuit may be described herein as performing write operations for "first" and "second" values. The terms "first" and "second" do not necessarily imply that the first value must be written before the second value.

"Based On" or "Dependent On." As used herein, these terms are used to describe one or more factors that affect a determination. These terms do not foreclose additional factors that may affect a determination. That is, a determination may be solely based on those factors or based, at least in part, on those factors. Consider the phrase "determine A based on B." While in this case, B is a factor that affects the determination of A, such a phrase does not foreclose the determination of A from also being based on C. In other instances, A may be determined based solely on B.

"Or." When used in the claims, the term "or" is used as an inclusive or and not as an exclusive or. For example, the phrase "at least one of x, y, or z" means any one of x, y, and z, as well as any combination thereof.

DETAILED DESCRIPTION

Various embodiments of methods and apparatus for predictive head-tracked binaural audio rendering are described. Embodiments of an audio rendering system and audio rendering methods are described that may, for example, be implemented by mobile multipurpose devices such as smartphones, pad devices, and tablet devices that render and transmit head-tracked binaural audio via wireless technology (e.g., Bluetooth) to binaural audio devices (e.g., headphones, earbuds, etc.) worn by the user. Embodiments may also be implemented in VR/AR systems that include a computing device (referred to as a base station) that renders and transmits head-tracked binaural audio via wireless technology to a head-mounted display (HMD) that provides binaural audio output, or to a separate binaural audio device used with a HMD. The device worn by the user that provides binaural audio output (e.g., a HMD, headphones, earbuds, etc.) may be referred to herein as the "headset." The device that renders and transmits audio to the headset may be referred to herein as the "rendering device." The headset may include head tracking technology (e.g., IMUs (inertial measurement units), gyroscopes, attitude sensors, compasses, etc.)

Head-tracked binaural audio rendering is a technique that may be used in applications including but not limited to VR/AR applications to create virtual audio sources that appear stable in the environment regardless of the listener's actual orientation/position. A head-tracked binaural audio rendering method may render and output a binaural audio stream (including left and right audio channels) to a headset so that the listener hears sounds in a spatial audio sense. In other words, the listener hears sounds as if the sounds were coming from real world locations with accurate distance and direction. For example, the system may play a sound through the headset so that the listener hears the sound coming from virtual sources on their left, their right, straight ahead, behind, or at some angle. Aspects of the left and right audio channels (e.g., level, frequency, delay, reverberation, etc.) may be attenuated to affect the perceived directionality and distance of a sound.

The headset includes a left audio output component worn in or over the user's left ear, and a right audio output component worn in or over the user's right ear. Directionality of a sound as perceived by the user may, for example, be provided by rendering the left and right audio channels of the binaural audio stream to increase the level of the sound output by one of the audio output components and/or to decrease the level of the sound output by the other audio output component. If both components are at the same level, the sound may seem to be coming from in front of the user. If the level is near zero in the right component and higher in the left component, the sound may seem to be coming from the direct left of the user. If the level is near zero in the left component and higher in the right component, the sound may seem to be coming from the direct right of the user. If the level is higher in the left component and lower in the right component, the sound may seem to be coming from a position in front of and to the left of the user. If the level is higher in the right component and lower in the left component, the sound may seem to be coming from a position in front of and to the right of the user. In addition, the sound output by one or both components may be modulated to make it seem that the sound is coming from behind the user. In addition, modulating the sound level of one or both components may provide a sense of distance; at a lower level, the sound may seem to be coming from farther away; at a higher level, the sound may seem to be coming from nearby. Instead of or in addition to adjusting the sound, other aspects of the left and right audio channels may be attenuated to affect the perceived directionality and distance of the audio, including but not limited to frequency, delay, and reverberation.

Unlike conventional audio, in head-tracked binaural audio, the virtual sources of the sounds do not move with the listener's head. This may be achieved by tracking motion of the listener's head, and adjusting the rendering of the binaural audio stream as the listener moves their head. However, perceived latency may be a problem in head tracking, rendering, and playing back the audio when responding to head movements. For example, by the time the rendered audio is played through the headset, the user's head may have moved. The virtual audio sources may initially move with the head, and then bounce back to their correct virtual locations when the movement stops. Latency may be particularly problematic when the head tracking data and audio are transmitted over a wireless link between the rendering device and the headset, which may add 300 ms or more to the latency. Performing both the rendering and playback on the headset reduces latency and thus may mitigate the latency problem. However, binaural audio rendering is computationally intensive, requiring expensive hardware (e.g., processors) and power. Using a separate rendering device such as a base station or mobile multipurpose device to perform the audio rendering allows for a more light-weight and inexpensive headset, as the heavy-duty rendering is performed by the rendering device. The rendering device may predict future head orientation/position based on the head tracking data and render an audio stream based on the prediction. However, this may result in the virtual audio sources being off-target when the head movement changes (i.e., starts, ends, accelerates) causing the actual head position to differ from the prediction.

In embodiments, to mitigate the problem with perceived latency, instead of generating a single audio stream based on a known or predicted head position, the rendering device renders multiple audio streams for multiple different head positions based on the head tracking data, for example audio streams for the last known position and one or more predicted or possible positions, and transmits the audio for these different positions to the headset in multiple audio streams. Metadata may be included with the audio streams that identifies the positions of the different streams. The headset then selects one of the audio streams that is closest to the actual head position based on current head tracking data and the metadata. Selecting an audio stream is a relatively simple and low-cost operation, and thus requires only minimal processing power on the headset. In some embodiments, if none of the audio streams closely match the actual head position, the headset may select two closest audio streams and mix the audio streams. In some embodiments, more than two audio streams may be selected and mixed by the headset. Sending multiple audio streams to the headset and selecting (or mixing) a matching audio stream on the headset may mitigate or eliminate perceived head tracking latency.

As a non-limiting example, if analysis of the head tracking data received from the headset by the rendering device indicates that the user's head is currently still, the rendering device may render and transmit an audio stream for the known position, for a position 5 degrees to the left of the known position, and for a position 5 degrees to the right of the known position in case the user turns their head during the time it takes to get the head tracking information to the rendering device, to render the audio, and to transmit the rendered audio to the headset. At the headset, the headset selects and plays the audio stream that is closest to the actual position of the head based on the most recent head tracking data, or alternatively mixes two of the streams if the actual position of the head is between two of the audio streams.

As another example, if analysis of the head tracking data received from the headset by the rendering device indicates that the user's head is turning at a known angular rate, the rendering device may render and transmit an audio stream at the currently known position (in case head movement stops), at a position predicted by the known angular rate, and at a position predicted at twice the known angular rate. At the headset, the headset selects and plays the audio stream that is closest to the actual position of the head based on the most recent head tracking data, or alternatively mixes two of the streams if the actual position of the head is between two of the audio streams.

In some embodiments, if there is a single virtual audio source, the rendering device may render a single audio stream based on a head position indicated by the head tracking data received from the headset. At the headset, the headset may alter the left and/or right audio channel to adjust the perceived location of the virtual audio source based on the actual position of the user's head determined from current head tracking data, for example by adding delay to the left or right audio channel.

In some embodiments, when multiple audio streams are rendered and transmitted, the rendering device may use a multichannel audio compression technique that leverages similarity in the audio signals to compress the audio signals and thus reduce wireless bandwidth usage.

While embodiments are generally described in which the rendering device renders multiple audio streams and the headset selects one or more audio streams to provide directionality of sound in one dimension (i.e., the horizontal dimension), embodiments may be used to provide directionality of sound in multiple dimensions, for example to provide sounds at azimuth angles, elevation angles, and sounds to indicate translational movements. For example, the base station may render audio streams at multiple positions in the horizontal dimension and also render audio streams above and/or below the horizontal dimension. At the headset, the headset selects and plays the audio stream that is closest to the actual position and elevation (or tilt) of the head based on the most recent head tracking data, or alternatively mixes two or more of the streams if the actual position of the head is somewhere between the audio streams.

While embodiments are described in reference to a mobile multipurpose device or a base station connected by wireless technology to a headset or HMD worn by the user, embodiments may also be implemented in other systems, for example in home entertainment systems that render and transmit binaural audio to headsets worn by users via wireless technology. Further, embodiments may also be implemented in systems that use wired rather than wireless technology to transmit binaural audio to headsets. More generally, embodiments may be implemented in any system that includes binaural audio output and that provides head motion and orientation tracking.

Figure 1B:
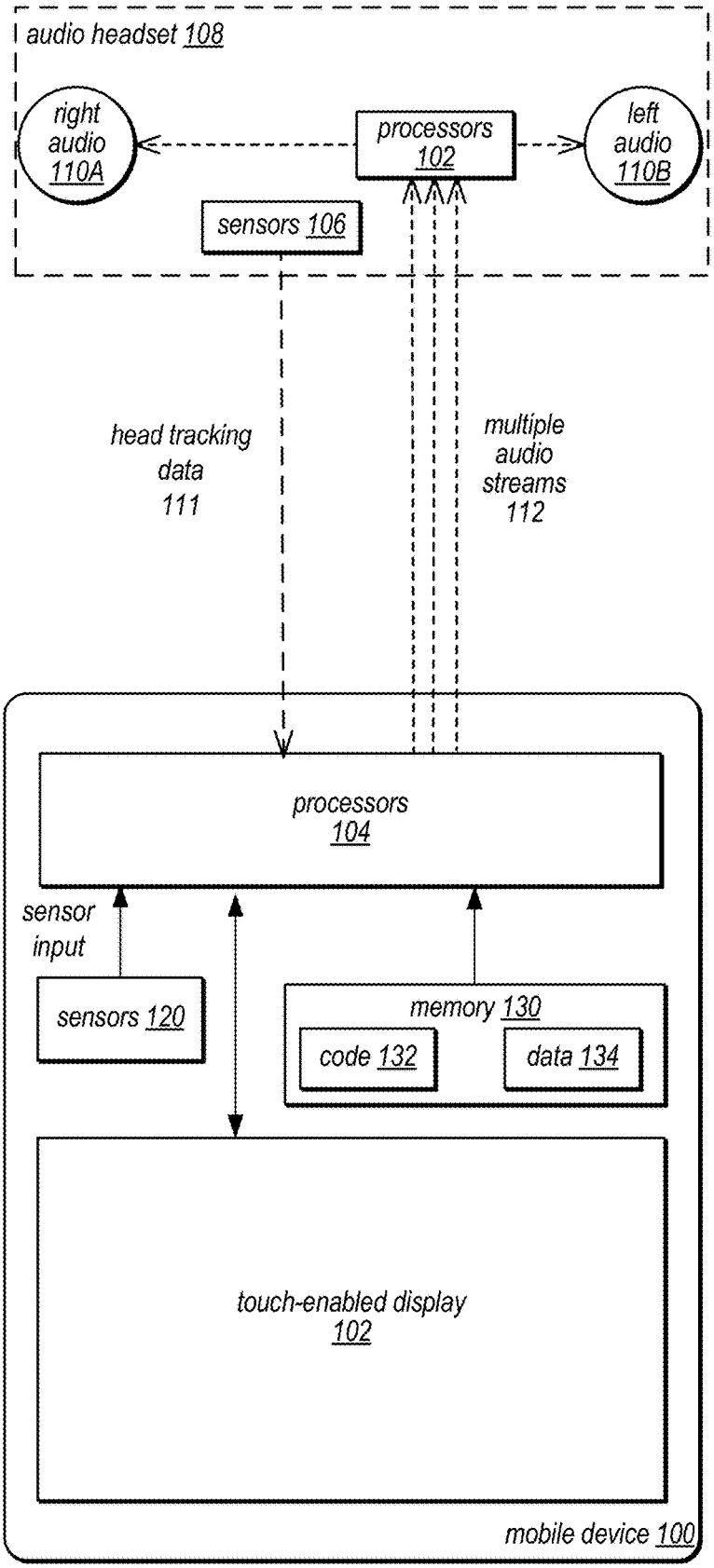

FIGS. 1A and 1B illustrate embodiments of an example mobile multipurpose device that may implement embodiments of the spatial audio navigation system and methods as described herein. As shown in FIG. 1A, a mobile device 100 such as a smartphone, tablet, or pad device may be carried by a user 190, for example in the hand or in a pocket. A binaural audio device (e.g., headphones, headsets, wired or wireless earbuds, etc.), referred to as a headset 108, may be worn by the user 190. The headset 108 may include right audio 110A and left audio 110B output components (e.g., earbuds) and one or more motion sensors 106 used to detect and track motion and orientation of the user 190's head with respect to the real world. The motion sensors may include one or more of, but are not limited to, IMUs (inertial measurement units), gyroscopes, attitude sensors, compasses, etc.

The headset 108 may communicate head orientation and movement information (head tracking data 111) to the device 100 via a wired or wireless connection. The mobile device 100 may render multiple audio streams 112 (each stream including right and left audio channels) for multiple different head positions based on the head tracking data 111, for example audio streams for the last known position and one or more predicted or possible positions, and transmits the audio streams 112 to the headset 108 via a wireless connection. Metadata may be included with the audio streams 112 to identify the positions of the different streams. Processor(s) 106 of the headset 108 may then select one of the audio streams 112 that is closest to the actual head position based on current head tracking data and the metadata. In some embodiments, if none of the audio streams 112 closely match the actual head position, processor(s) 106 of the headset 108 may select two closest audio streams and mix the audio streams. Right and left channels of the selected (or mixed) audio stream are then played to the right audio 110A and left audio 110B output components of the headset 108.

FIG. 1B is a block diagram further illustrating components of a system as illustrated in FIG. 1A, according to some embodiments. A mobile multipurpose device 100 such as a smartphone, tablet, or pad device may include, but is not limited to, one or more processors 104, a memory 130, one or more sensors 120, and a touch-enabled display 102.

Device 100 may include a touch-enabled display 102 via which content may be displayed to the user, and via which the user may input information and commands to the device 100. Display 102 may implement any of various types of touch-enabled display technologies.

Device 100 may also include one or more processors 104 that implement functionality of the mobile multipurpose device. Device 100 may also include a memory 130 that stores software (code 132) that is executable by the processors 104, as well as data 134 that may be used by the code 132 when executing on the processors 104. Code 132 and data 134 may, for example, include code and data for executing an operating system of the device 100, as well as code and data for implementing various applications on the device 100. Code 132 may also include, but is not limited to, program instructions executable by the controller 104 for implementing the predictive head-tracked binaural audio rendering methods as described herein. Data 134 may also include, but is not limited to, real-world map information, audio files, or other data that may be used by the predictive head-tracked binaural audio rendering methods as described herein.

In various embodiments, processors 104 may be a uniprocessor system including one processor, or a multiprocessor system including several processors (e.g., two, four, eight, or another suitable number). Processors 104 may include central processing units (CPUs) configured to implement any suitable instruction set architecture, and may be configured to execute instructions defined in that instruction set architecture. For example, in various embodiments processors 104 may include general-purpose or embedded processors implementing any of a variety of instruction set architectures (ISAs), such as the x86, PowerPC, SPARC, RISC, or MIPS ISAs, or any other suitable ISA. In multiprocessor systems, each of the processors may commonly, but not necessarily, implement the same ISA. Processors 104 may employ any microarchitecture, including scalar, superscalar, pipelined, superpipelined, out of order, in order, speculative, non-speculative, etc., or combinations thereof. Processors 104 may include circuitry to implement microcoding techniques. Processors 104 may include one or more processing cores each configured to execute instructions. Processors 104 may include one or more levels of caches, which may employ any size and any configuration (set associative, direct mapped, etc.). In some embodiments, processors 104 may include at least one audio processing unit (APU), which may include any suitable audio processing circuitry. In some embodiments, processors 104 may include at least one graphics processing unit (GPU), which may include any suitable graphics processing circuitry. Generally, a GPU may be configured to render objects to be displayed into a frame buffer (e.g., one that includes pixel data for an entire frame). A GPU may include one or more graphics processors that may execute graphics software to perform a part or all of the graphics operation, or hardware acceleration of certain graphics operations. In some embodiments, processors 104 may include one or more other components for processing and rendering video and/or images, for example image signal processors (ISPs), coder/decoders (codecs), etc. In some embodiments, processors 104 may include at least one system on a chip (SOC).

Memory 130 may include any type of memory, such as dynamic random access memory (DRAM), synchronous DRAM (SDRAM), double data rate (DDR, DDR2, DDR3, etc.) SDRAM (including mobile versions of the SDRAMs such as mDDR3, etc., or low power versions of the SDRAMs such as LPDDR2, etc.), RAMBUS DRAM (RDRAM), static RAM (SRAM), etc. In some embodiments, one or more memory devices may be coupled onto a circuit board to form memory modules such as single inline memory modules (SIMMs), dual inline memory modules (DIMMs), etc. Alternatively, the devices may be mounted with an integrated circuit implementing system in a chip-on-chip configuration, a package-on-package configuration, or a multi-chip module configuration.

The device 100 may include one or more position sensors 120, for example sensors that enable a real-world location of the device 100 to be determined, for example GPS (global positioning system) technology sensors, dGPS (differential GPS) technology sensors, cameras, indoor positioning technology sensors, SLAM (simultaneous localization and mapping) technology sensors, etc.

A binaural audio device (e.g., headphones, headsets, wired or wireless earbuds, etc.), referred to as a headset 108, may be worn by the user. The headset 108 may include right audio 110A and left audio 110B output components (e.g., earbuds) and one or more motion sensors 106 used to detect and track motion and orientation of the user 190's head with respect to the real world. The motion sensors 106 may include one or more of, but are not limited to, IMUs (inertial measurement unit), gyroscopes, attitude sensors, compasses, etc. The headset 108 may also include one or more processors 102. In some embodiments, processors 102 may include at least one audio processing unit (APU), which may include any suitable audio processing circuitry.

The headset 108 may communicate head orientation and movement information (head tracking data 111) to the device 100 via a wired or wireless connection. The mobile device 100 may render multiple audio streams 112 (each stream including right and left audio channels) for multiple different head positions based on the head tracking data 111, for example audio streams for the last known head position and one or more predicted or possible positions, and transmits the audio streams 112 to the headset 108 via a wireless connection. Metadata may be included with the audio streams 112 to identify the positions of the different streams. Processor(s) 106 of the headset 108 may then select one of the audio streams 112 that is closest to the actual head position based on current head tracking data and the metadata. In some embodiments, if none of the audio streams 112 closely match the actual head position, processor(s) 106 of the headset 108 may select two closest audio streams and mix the audio streams. Right and left channels of the selected (or mixed) audio stream are then played to the right audio 110A and left audio 110B output components of the headset 108.

Figure 2A:
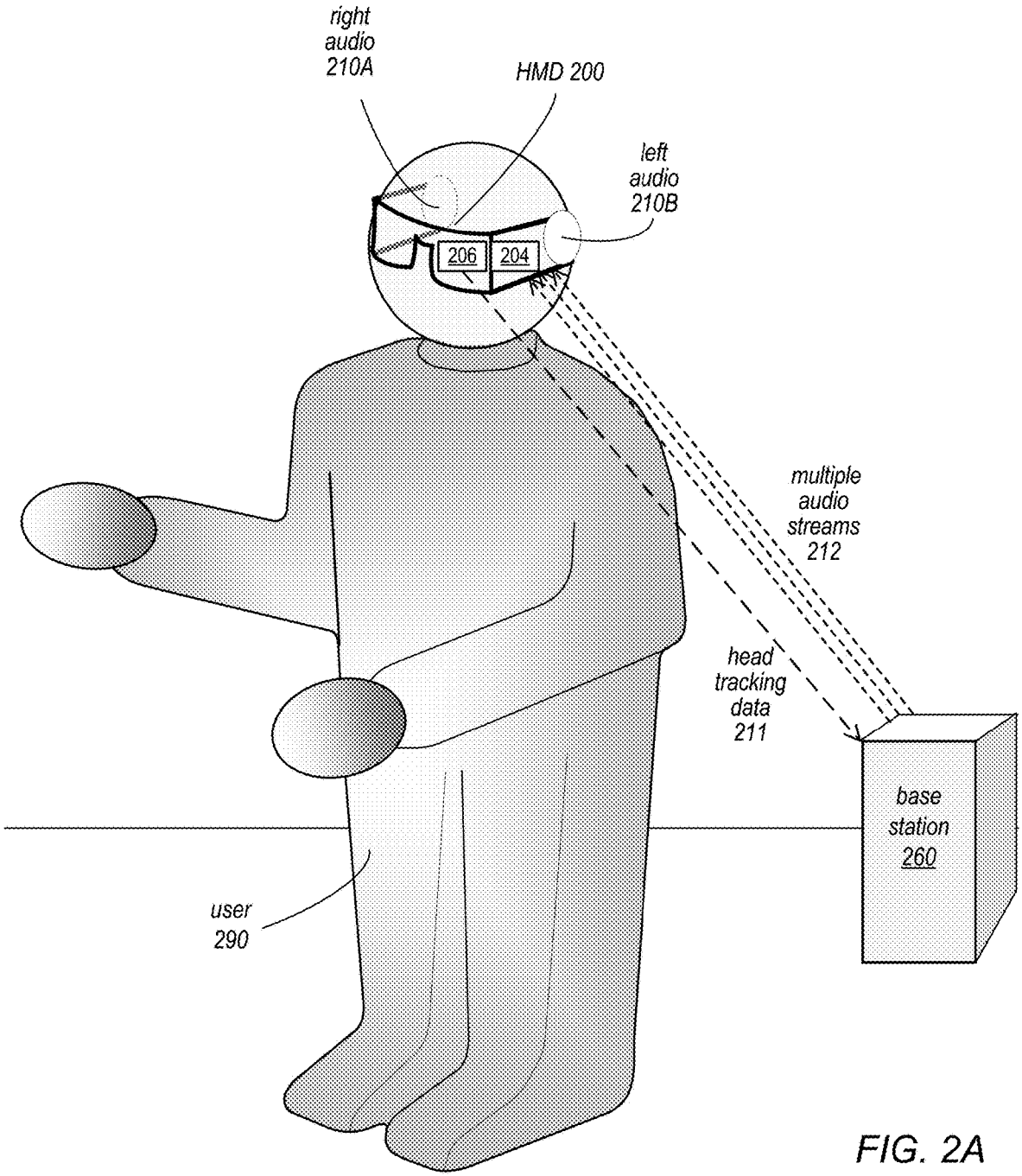
FIGS. 2A and 2B illustrate embodiments of an example VR/AR system that may implement embodiments of the audio rendering methods as described herein.
Figure 2B:
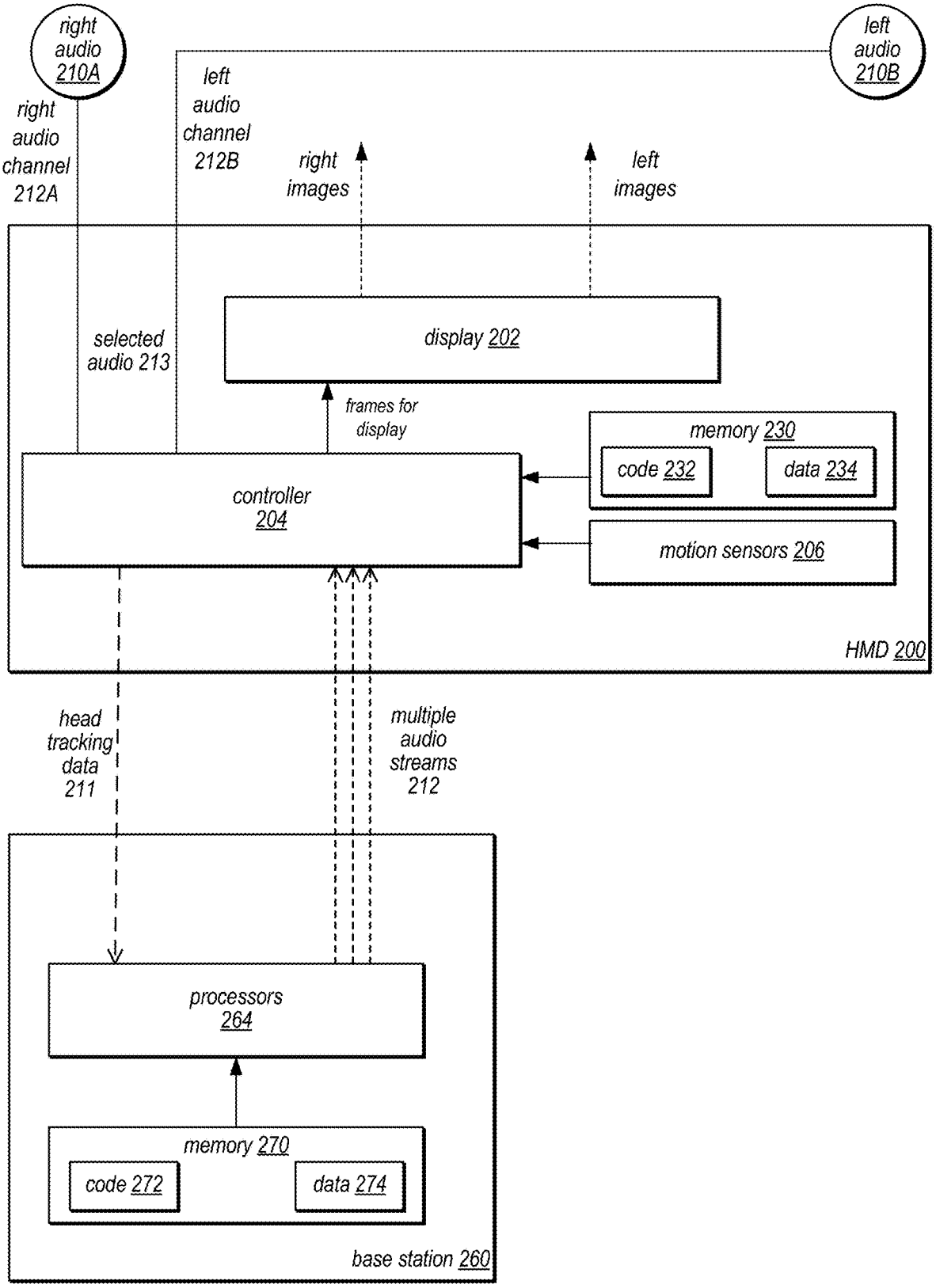

FIGS. 2A and 2B illustrate embodiments of an example VR/AR system that may implement embodiments of the predictive head-tracked binaural audio rendering methods as described herein.

FIG. 2A illustrates a VR/AR system, according to at least some embodiments. In some embodiments, a VR/AR system may include a HMD 200 such as a helmet, goggles, or glasses that may be worn by a user 290. The VR/AR system may also include a base station 260 that performs at least some of the functionality of the VR/AR system (e.g., rendering virtual content for display and accompanying audio) and that communicates with the HMD 200 via a wireless connection.

The HMD 200 may include sensors that collect information about the user 290's environment (video, depth information, lighting information, etc.) and information about the user 290 (e.g., the user's expressions, eye movement, head movement, gaze direction, hand gestures, etc.). Virtual content may be rendered based at least in part on the various information obtained from the sensors for display to the user 290. The virtual content may be displayed by the HMD 200 to the user 290 to provide a virtual reality view (in VR applications) or to provide an augmented view of reality (in MR applications). HMD 200 may implement any of various types of display technologies. The HMD 200 may also include one or more position sensors that enable a real-world location of the HMD 200 to be determined, for example GPS (global positioning system) technology sensors, dGPS (differential GPS) technology sensors, cameras, indoor positioning technology sensors, SLAM (simultaneous localization and mapping) technology sensors, etc. The HMD 200 may also include one or more motion sensors 206 used to detect and track motion and orientation of the user 290's head with respect to the real world. The motion sensors 206 may include one or more of, but are not limited to, IMUs (inertial measurement units), gyroscopes, attitude sensors, compasses, etc.

The HMD 200 may provide binaural audio output (e.g., via right audio 210A and left audio 210B output components). For example, right audio 210A and left audio 210B output components may be over the ear speakers or ear pieces integrated in the HMD 200 and positioned at or over the user's right and left ears, respectively. As another example, right audio 210A and left audio 210B output components may be right and left earbuds or headphones coupled to the HMD 200 by a wired or wireless connection.

The HMD 200 may communicate head orientation and movement information (head tracking data 211) to the base station 260 via a wireless connection. Base station 260 may render multiple audio streams 212 (each stream including right and left audio channels) for multiple different head positions based on the head tracking data 211, for example audio streams for the last known position and one or more predicted or possible positions, and transmits the audio streams 212 to the HMD 200 via the wireless connection. Metadata may be included with the audio streams 212 to identify the positions of the different streams. A controller 204 comprising one or more processors on the HMD 200 may then select one of the audio streams 212 that is closest to the actual head position based on current head tracking data and the metadata. In some embodiments, if none of the audio streams 212 closely match the actual head position, controller 204 may select two closest audio streams and mix the audio streams. Right and left channels of the selected (or mixed) audio stream are then played to the right audio 210A and left audio 210B output components of the HMD 200.

FIG. 2B is a block diagram further illustrating components of a VR/AR system as illustrated in FIG. 2A, according to some embodiments. In some embodiments, a VR/AR system may include a HMD 200 such as a headset, helmet, goggles, or glasses. The VR/AR system may also include a base station 260 that performs at least some of the functionality of the VR/AR system (e.g., rendering virtual content for display and accompanying audio) and that communicates with the HMD 200 via a wireless connection.

HMD 200 may include a display 202 component or subsystem via which virtual content may be displayed to the user to provide a virtual reality view (in VR applications) or to provide an augmented view of reality (in MR applications). Display 202 may implement any of various types of display technologies. For example, HMD 200 may include a near-eye display system that displays left and right images on screens in front of the user 290's eyes, such as DLP (digital light processing), LCD (liquid crystal display) and LCoS (liquid crystal on silicon) technology display systems. As another example, HMD 200 may include a projector system that scans left and right images to the subject's eyes. To scan the images, left and right projectors generate beams that are directed to left and right displays (e.g., ellipsoid mirrors) located in front of the user 290's eyes; the displays reflect the beams to the user's eyes. The left and right displays may be see-through displays that allow light from the environment to pass through so that the user sees a view of reality augmented by the projected virtual content.

HMD 200 may also include a controller 204 comprising one or more processors that implements HMD-side functionality of the VR/AR system. HMD 200 may also include a memory 230 that stores software (code 232) that is executable by the controller 204, as well as data 234 that may be used by the code 232 when executing on the controller 204. Code 232 and data 234 may, for example, include VR and/or AR application code and data for displaying virtual content to the user. Code 232 and data 234 may also include, but is not limited to, program instructions and data for implementing predictive head-tracked binaural audio rendering methods as described herein.

In various embodiments, controller 204 may be a uniprocessor system including one processor, or a multiprocessor system including several processors (e.g., two, four, eight, or another suitable number). Controller 204 may include central processing units (CPUs) configured to implement any suitable instruction set architecture, and may be configured to execute instructions defined in that instruction set architecture. For example, in various embodiments controller 204 may include general-purpose or embedded processors implementing any of a variety of instruction set architectures (ISAs), such as the x86, PowerPC, SPARC, RISC, or MIPS ISAs, or any other suitable ISA. In multiprocessor systems, each of the processors may commonly, but not necessarily, implement the same ISA. Controller 204 may employ any microarchitecture, including scalar, superscalar, pipelined, superpipelined, out of order, in order, speculative, non-speculative, etc., or combinations thereof. Controller 204 may include circuitry to implement microcoding techniques. Controller 204 may include one or more processing cores each configured to execute instructions. Controller 204 may include one or more levels of caches, which may employ any size and any configuration (set associative, direct mapped, etc.). In some embodiments, controller 204 may include at least one audio processing unit (APU), which may include any suitable audio processing circuitry. In some embodiments, controller 204 may include at least one graphics processing unit (GPU), which may include any suitable graphics processing circuitry. Generally, a GPU may be configured to render objects to be displayed into a frame buffer (e.g., one that includes pixel data for an entire frame). A GPU may include one or more graphics processors that may execute graphics software to perform a part or all of the graphics operation, or hardware acceleration of certain graphics operations. In some embodiments, controller 204 may include one or more other components for processing and/or rendering video and/or images, for example image signal processors (ISPs), coder/decoders (codecs), etc. In some embodiments, controller 204 may include at least one system on a chip (SOC).

Memory 230 may include any type of memory, such as dynamic random access memory (DRAM), synchronous DRAM (SDRAM), double data rate (DDR, DDR2, DDR3, etc.) SDRAM (including mobile versions of the SDRAMs such as mDDR3, etc., or low power versions of the SDRAMs such as LPDDR2, etc.), RAMBUS DRAM (RDRAM), static RAM (SRAM), etc. In some embodiments, one or more memory devices may be coupled onto a circuit board to form memory modules such as single inline memory modules (SIMMs), dual inline memory modules (DIMMs), etc. Alternatively, the devices may be mounted with an integrated circuit implementing system in a chip-on-chip configuration, a package-on-package configuration, or a multi-chip module configuration.

In some embodiments, the HMD 200 may include sensors that collect information about the user's environment (video, depth information, lighting information, etc.), and information about the user (e.g., the user's expressions, eye movement, hand gestures, etc.). The sensors may provide the collected information to the controller 204 of the HMD 200. Sensors may include one or more of, but are not limited to, visible light cameras (e.g., video cameras), infrared (IR) cameras, IR cameras with an IR illumination source, Light Detection and Ranging (LIDAR) emitters and receivers/detectors, and laser-based sensors with laser emitters and receivers/detectors. At least some of the sensor data may be transmitted to the base station 260.

HMD 200 may include at least one motion sensor 206 such as an inertial-measurement unit (IMU) for detecting position, orientation, and motion of the HMD 200 and thus of the user's head with respect to the real world. Instead of or in addition to an IMU, motion sensors 206 may include gyroscopes, attitude sensors, compasses, or other sensor technologies for detecting position, orientation, and motion of the HMD 200 and thus of the user's head with respect to the real world.

HMD 200 may include one or more position sensors that enable a real-world location of the HMD 200 to be determined, for example GPS (global positioning system) technology sensors, dGPS (differential GPS) technology sensors, cameras, indoor positioning technology sensors, SLAM (simultaneous localization and mapping) technology sensors, etc.

HMD 200 may provide binaural audio output (e.g., via right audio 210A and left audio 210B output components). For example, right audio 210A and left audio 210B may be over-the-ear speakers or ear pieces integrated in the HMD 200 and positioned at or over the user's right and left ears, respectively. As another example, right audio 210A and left audio 210B may be right and left earbuds or headphones coupled to the HMD 200 by a wired or wireless connection. HMD may transmit right 212A and left 212B audio channels to the right audio 210A and left audio 210B output components via a wired or wireless connection.

Base station 260 may include one or more processors 264 that implement base station-side functionality of the VR/AR system. Base station 260 may also include a memory 270 that stores software (code 272) that is executable by processors 264, as well as data 274 that may be used by the code 272 when executing on the processors 264. Code 272 and data 274 may, for example, include VR and/or AR application code and data for rendering virtual content to be displayed to the user. Code 272 and data 274 may also include, but is not limited to, program instructions and data for implementing predictive head-tracked binaural audio rendering methods as described herein.

In various embodiments, processors 264 may be a uniprocessor system including one processor, or a multiprocessor system including several processors (e.g., two, four, eight, or another suitable number). Processors 264 may include central processing units (CPUs) configured to implement any suitable instruction set architecture, and may be configured to execute instructions defined in that instruction set architecture. For example, in various embodiments processors 264 may include general-purpose or embedded processors implementing any of a variety of instruction set architectures (ISAs), such as the x86, PowerPC, SPARC, RISC, or MIPS ISAs, or any other suitable ISA. In multiprocessor systems, each of the processors may commonly, but not necessarily, implement the same ISA. Processors 264 may employ any microarchitecture, including scalar, superscalar, pipelined, superpipelined, out of order, in order, speculative, non-speculative, etc., or combinations thereof. Processors 264 may include circuitry to implement microcoding techniques. Processors 264 may include one or more processing cores each configured to execute instructions. Processors 264 may include one or more levels of caches, which may employ any size and any configuration (set associative, direct mapped, etc.). In some embodiments, processors 264 may include at least one audio processing unit (APU), which may include any suitable audio processing circuitry. In some embodiments, processors 264 may include at least one graphics processing unit (GPU), which may include any suitable graphics processing circuitry.

Generally, a GPU may be configured to render objects to be displayed into a frame buffer (e.g., one that includes pixel data for an entire frame). A GPU may include one or more graphics processors that may execute graphics software to perform a part or all of the graphics operation, or hardware acceleration of certain graphics operations. In some embodiments, processors 264 may include one or more other components for processing and/or rendering video and/or images, for example image signal processors (ISPs), coder/decoders (codecs), etc. In some embodiments, processors 264 may include at least one system on a chip (SOC).

Memory 270 may include any type of memory, such as dynamic random access memory (DRAM), synchronous DRAM (SDRAM), double data rate (DDR, DDR2, DDR3, etc.) SDRAM (including mobile versions of the SDRAMs such as mDDR3, etc., or low power versions of the SDRAMs such as LPDDR2, etc.), RAMBUS DRAM (RDRAM), static RAM (SRAM), etc. In some embodiments, one or more memory devices may be coupled onto a circuit board to form memory modules such as single inline memory modules (SIMMs), dual inline memory modules (DIMMs), etc. Alternatively, the devices may be mounted with an integrated circuit implementing system in a chip-on-chip configuration, a package-on-package configuration, or a multi-chip module configuration.

The HMD 200 may communicate head orientation and movement information (head tracking data 211) to the base station 260 via a wireless connection. Base station 260 may render multiple audio streams 212 (each stream including right and left audio channels) for multiple different head positions based on the head tracking data 211, for example audio streams for the last known position and one or more predicted or possible positions, and transmits the audio streams 212 to the HMD 200 via the wireless connection. Metadata may be included with the audio streams 212 to identify the positions of the different streams. Controller 204 may then select one of the audio streams 212 that is closest to the actual head position based on current head tracking data and the metadata. In some embodiments, if none of the audio streams 212 closely match the actual head position, controller 204 may select two closest audio streams and mix the audio streams. Right and left channels of the selected (or mixed) audio stream are then played to the right audio 210A and left audio 210B output components of the HMD 200.

Figure 2C:
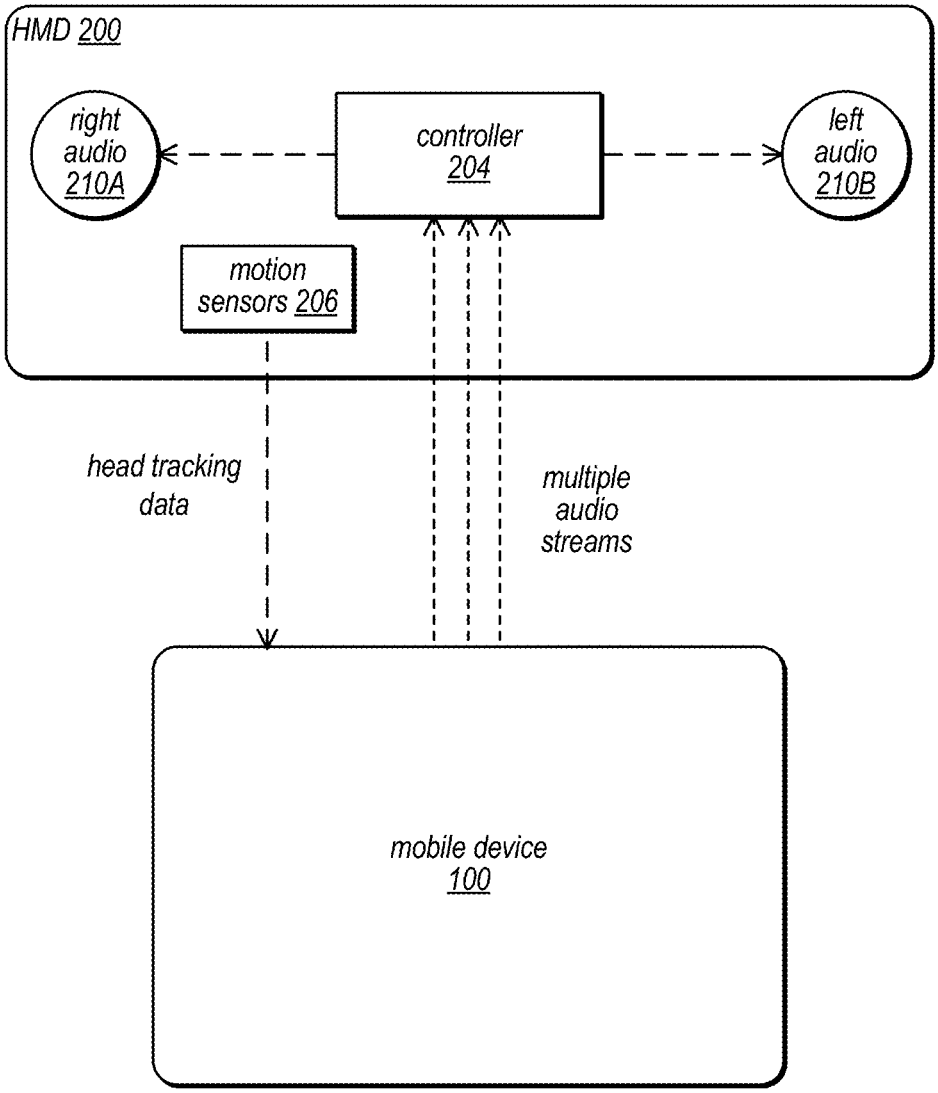
FIG. 2C illustrates a mobile multipurpose device used with a VR/AR system to implement embodiments of the audio rendering methods as described herein.

FIG. 2C illustrates a mobile multipurpose device used with a VR/AR system to implement embodiments of the audio rendering methods as described herein. In some embodiments, a mobile multipurpose device 100 as illustrated in FIGS. 1A and 1B may be used with a HMD as illustrated in FIGS. 2A and 2B. The HMD 200 may communicate head orientation and movement information (head tracking data) collected by motion sensors 206 to the device 100 via a wireless connection. Device 100 may render multiple audio streams (each stream including right and left audio channels) for multiple different head positions based on the head tracking data, for example audio streams for the last known position and one or more predicted or possible positions, and transmits the audio streams to the HMD 200 via the wireless connection. Metadata may be included with the audio streams to identify the positions of the different streams. The controller 204 of the HMD 200 may then select one of the audio streams that is closest to the actual head position based on current head tracking data and the metadata. In some embodiments, if none of the audio streams closely match the actual head position, the controller 204 may select two closest audio streams and mix the audio streams. Right and left channels of the selected (or mixed) audio stream are then played to the right audio 210A and left audio 210B output components of the HMD 200.

Figure 3:
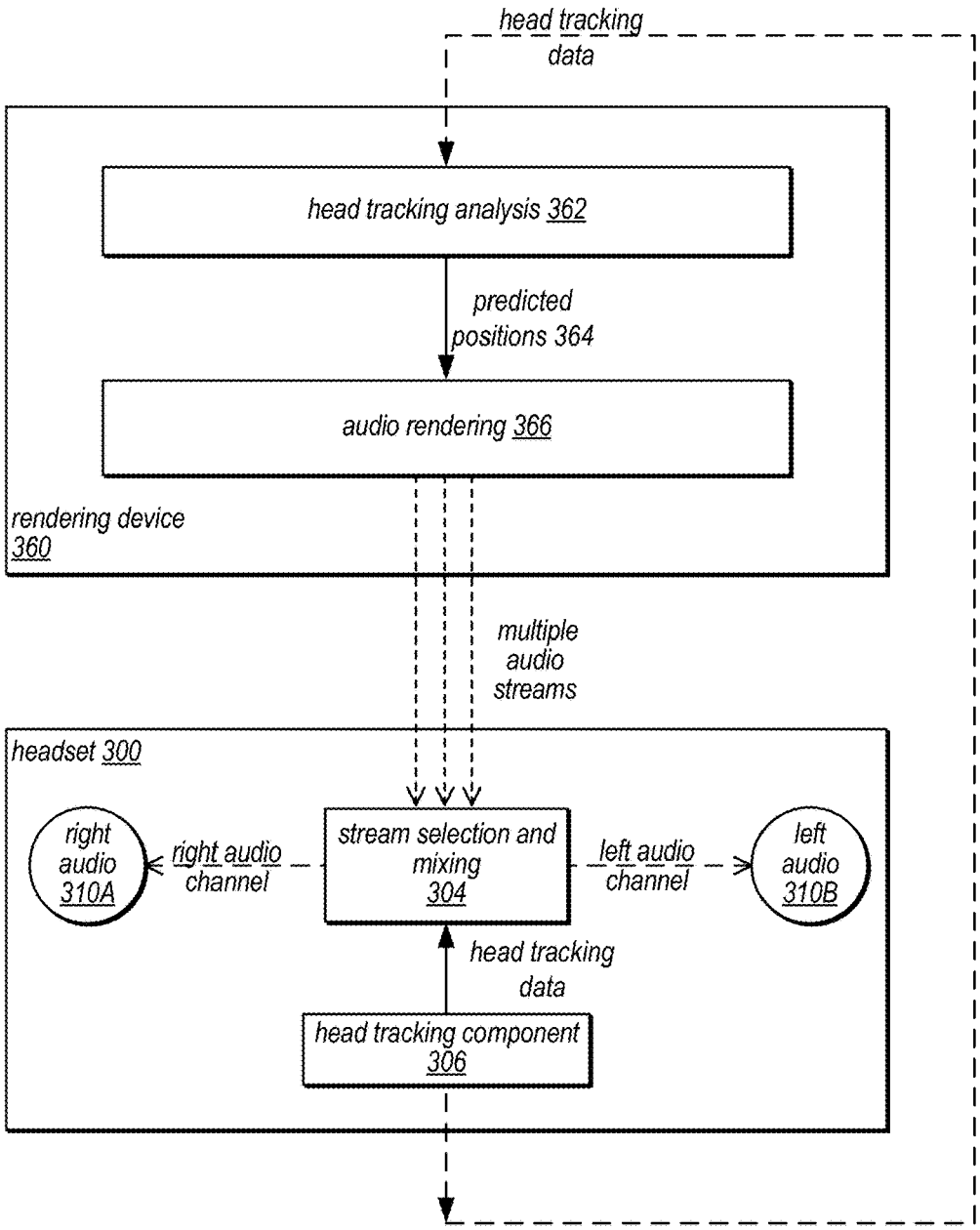
FIG. 3 illustrates components of an audio rendering system, according to some embodiments.

FIG. 3 illustrates components of an audio rendering system, according to some embodiments. An audio rendering system may be implemented by a mobile multipurpose device 100 and headset 108 as illustrated in FIGS. 1A and 1B, by an HMD 200 and base station 260 as illustrated in FIGS. 2A and 2B, or by a mobile multipurpose device 100 and HMD 200 as illustrated in FIG. 2C. More generally, embodiments may be implemented in any device or system that renders binaural audio output and that provides head motion and orientation tracking.

In embodiments of the audio rendering system, a head tracking component 306 of the headset 300 may collect head tracking data. The head tracking data may be transmitted to the rendering device 360 via a wireless connection. At the rendering device 360, a head tracking analysis component 362 may analyze the head tracking data to determine position and motion of the user's head and to generate two or more predicted positions 364, for example a current head position and one or more possible positions based on the current position and angular rate of movement. An audio rendering component 366 of the rendering device 360 may then render multiple audio streams corresponding to the predicted positions 364.

The multiple audio streams are transmitted to the headset 300 over the wireless connection. Metadata may be included with the audio streams to identify the positions of the different streams. In some embodiments, the rendering device 360 may use a multichannel audio compression technique that leverages similarity in the audio signals to compress the audio signals and thus reduce wireless bandwidth usage.

At the headset 300, a stream selection and mixing component 304 may then select one of the audio streams that is closest to the actual head position based on current head tracking data from the head tracking component 306 and the metadata. In some embodiments, if none of the audio streams closely match the actual head position, stream selection and mixing component 304 may select two closest audio streams and mix the audio streams. Right and left channels of the selected (or mixed) audio stream are then played to the right audio 310A and left audio 310B output components of the headset 300. The right and left audio channels are rendered so that the user hears the sound in a spatial audio sense. In other words, the user hears sounds as if the sounds were coming from real world locations with accurate distance and direction. For example, the system may play a sound through the headset so that the user hears the sound coming from their left, their right, straight ahead, behind, or at some angle. As the user moves their head, the predictive head-tracked binaural audio rendering methods described herein cause the virtual sources of sounds to remain stable in the environment regardless of the orientation/position of the user's head without perceived latency problems as in conventional systems.

As a non-limiting example, if analysis of the head tracking data received from the headset 300 by the rendering device 360 indicates that the user's head is currently still, the rendering device 360 may render and transmit an audio stream for the known position, for a position 5 degrees to the left of the known position, and for a position 5 degrees to the right of the known position in case the user turns their head during the time it takes to get the head tracking information to the rendering device 360, to render the audio, and to transmit the rendered audio to the headset 300. At the headset 300, the headset 300 selects and plays the audio stream that is closest to the actual position of the head based on the most recent head tracking data, or alternatively mixes two of the streams if the actual position of the head is between two of the audio streams.

As another example, if analysis of the head tracking data received from the headset 300 by the rendering device 360 indicates that the user's head is turning at a known angular rate, the rendering device 360 may render and transmit an audio stream at the currently known position (in case head movement stops), at a position predicted by the known angular rate, and at a position predicted at twice the known angular rate. At the headset 300, the headset 300 selects and plays the audio stream that is closest to the actual position of the head based on the most recent head tracking data, or alternatively mixes two of the streams if the actual position of the head is between two of the audio streams.

Figure 4:
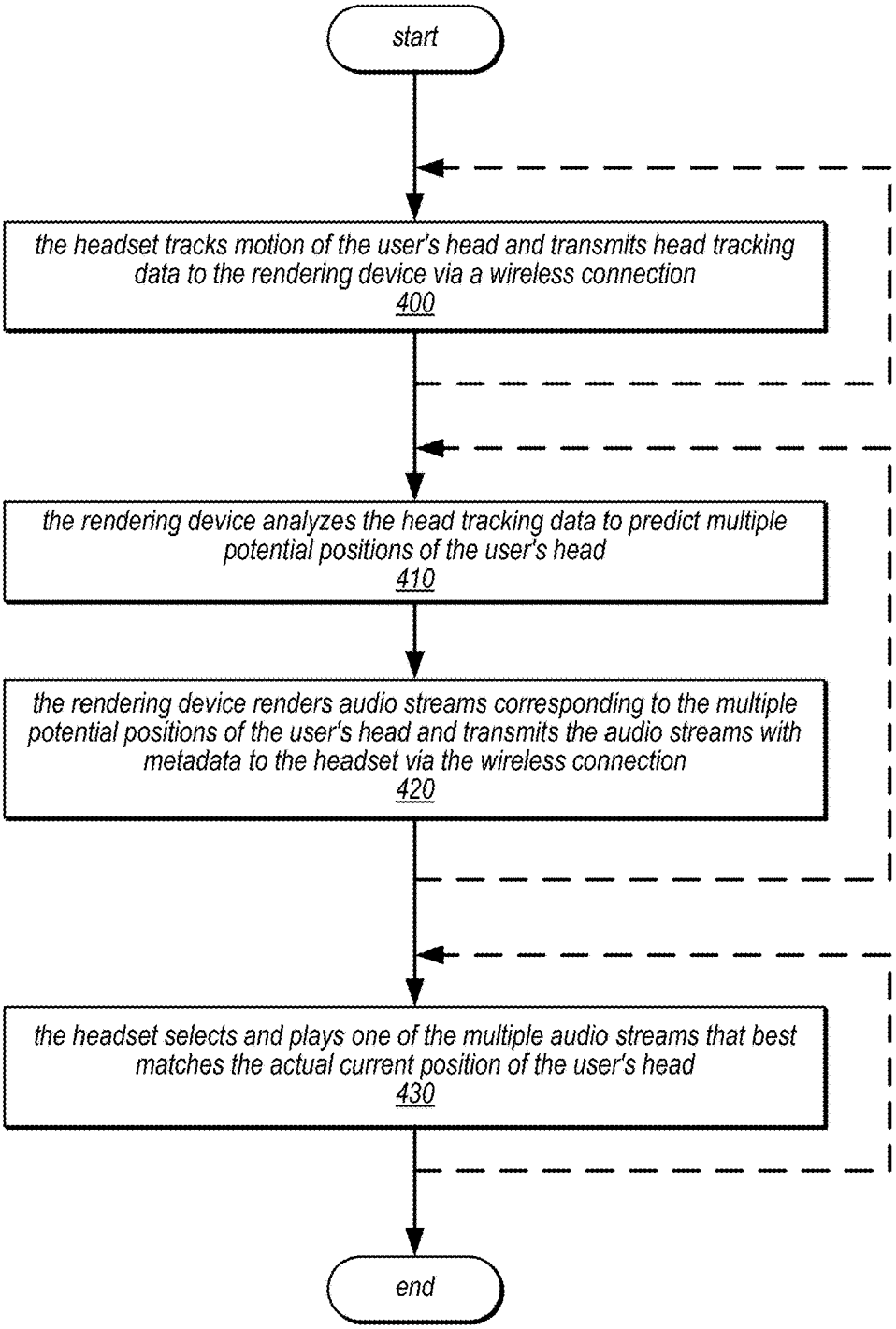
FIG. 4 is a flowchart of an audio rendering method that may be implemented by systems as illustrated in FIGS. 1A through 3, according to some embodiments.

FIG. 4 is a high-level flowchart of an audio rendering method that may be implemented by systems as illustrated in FIGS. 1A through 3, according to some embodiments. As indicated at 400, the headset tracks motion of the user's head and transmits head tracking data to the rendering device via a wireless connection. As indicated at 410, the rendering device analyzes the head tracking data to predict multiple potential positions of the user's head. As indicated at 420, the rendering device renders audio streams corresponding to multiple potential positions of the user's head and transmits the audio streams with metadata to the headset via the wireless connection. As indicated at 430, the headset selects and plays one of the multiple audio streams that best matches the actual current position of the user's head.

As indicated by the dashed lines in FIG. 4, the method may be a continuous process in which the headset continuously collects and sends head tracking data to the rendering device, the rendering device periodically or aperiodically analyzes the head tracking data to render and send audio streams to the headset, and the headset selects best matching audio streams to be played from among the audio streams received from the rendering device.

Figure 5:
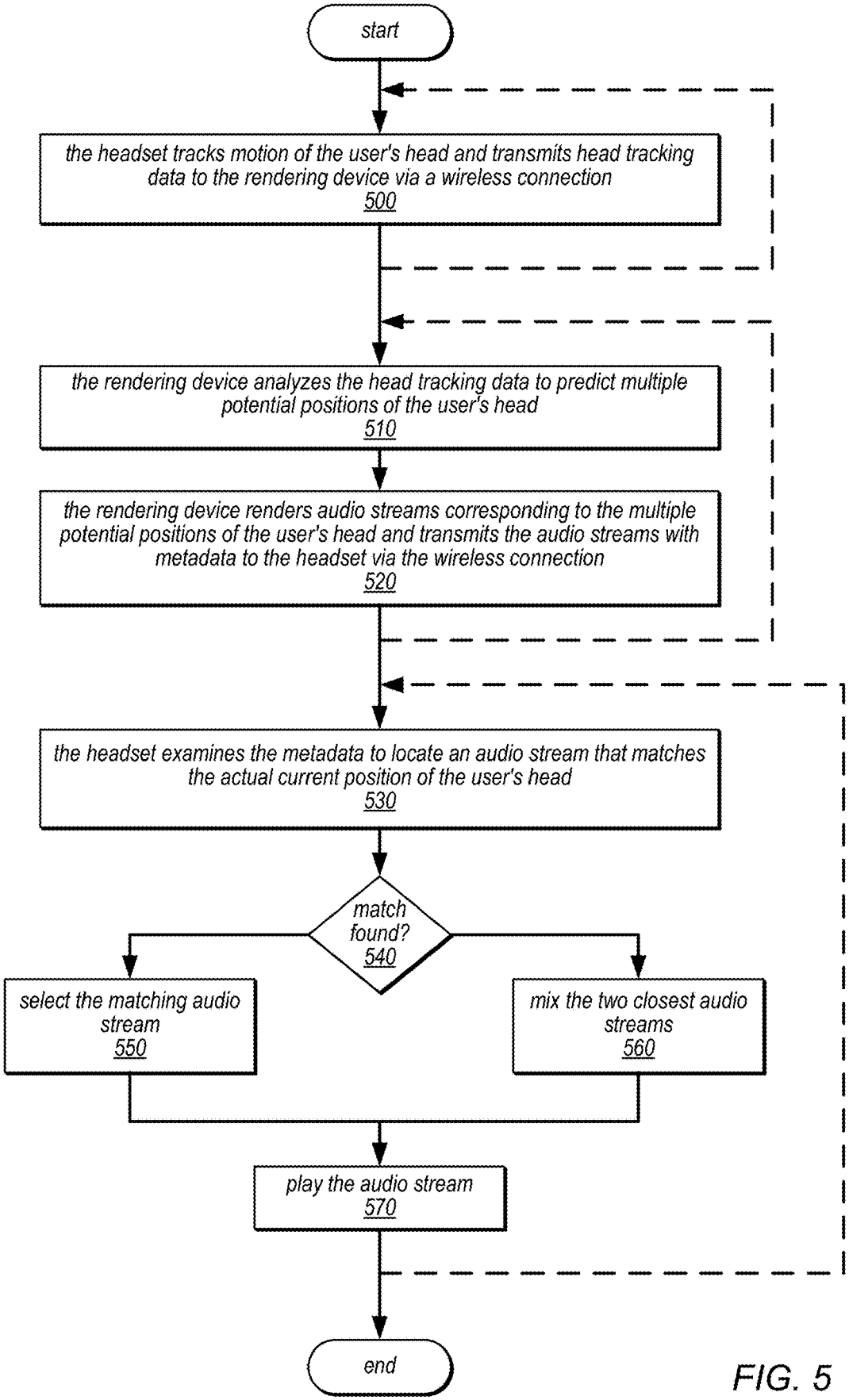
FIG. 5 is a flowchart of an audio rendering method in which audio streams may be mixed that may be implemented by systems as illustrated in FIGS. 1A through 3.

FIG. 5 is a high-level flowchart of an audio rendering method in which audio streams may be mixed that may be implemented by systems as illustrated in FIGS. 1A through 3. As indicated at 500, the headset tracks motion of the user's head and transmits head tracking data to the rendering device via a wireless connection. As indicated at 510, the rendering device analyzes the head tracking data to predict multiple potential positions of the user's head. As indicated at 520, the rendering device renders audio streams corresponding to multiple potential positions of the user's head and transmits the audio streams with metadata to the headset via the wireless connection. As indicated at 530, the headset examines the metadata to locate an audio stream that matches the actual current position of the user's head. At 540, if an audio stream is found that closely matches the actual current position of the user's head, then that audio stream is selected as indicated at 540. Otherwise, two closest audio streams are selected and mixed to produce an audio stream approximately at the actual current position of the user's head as indicated at 560. The selected or mixed audio stream is then played, as indicated at 570.

As indicated by the dashed lines in FIG. 5, the method may be a continuous process in which the headset continuously collects and sends head tracking data to the rendering device, the rendering device periodically or aperiodically analyzes the head tracking data to render and send audio streams to the headset, and the headset selects best matching audio streams or mixes audio streams to be played from among the audio streams received from the rendering device.

Figure 6A:
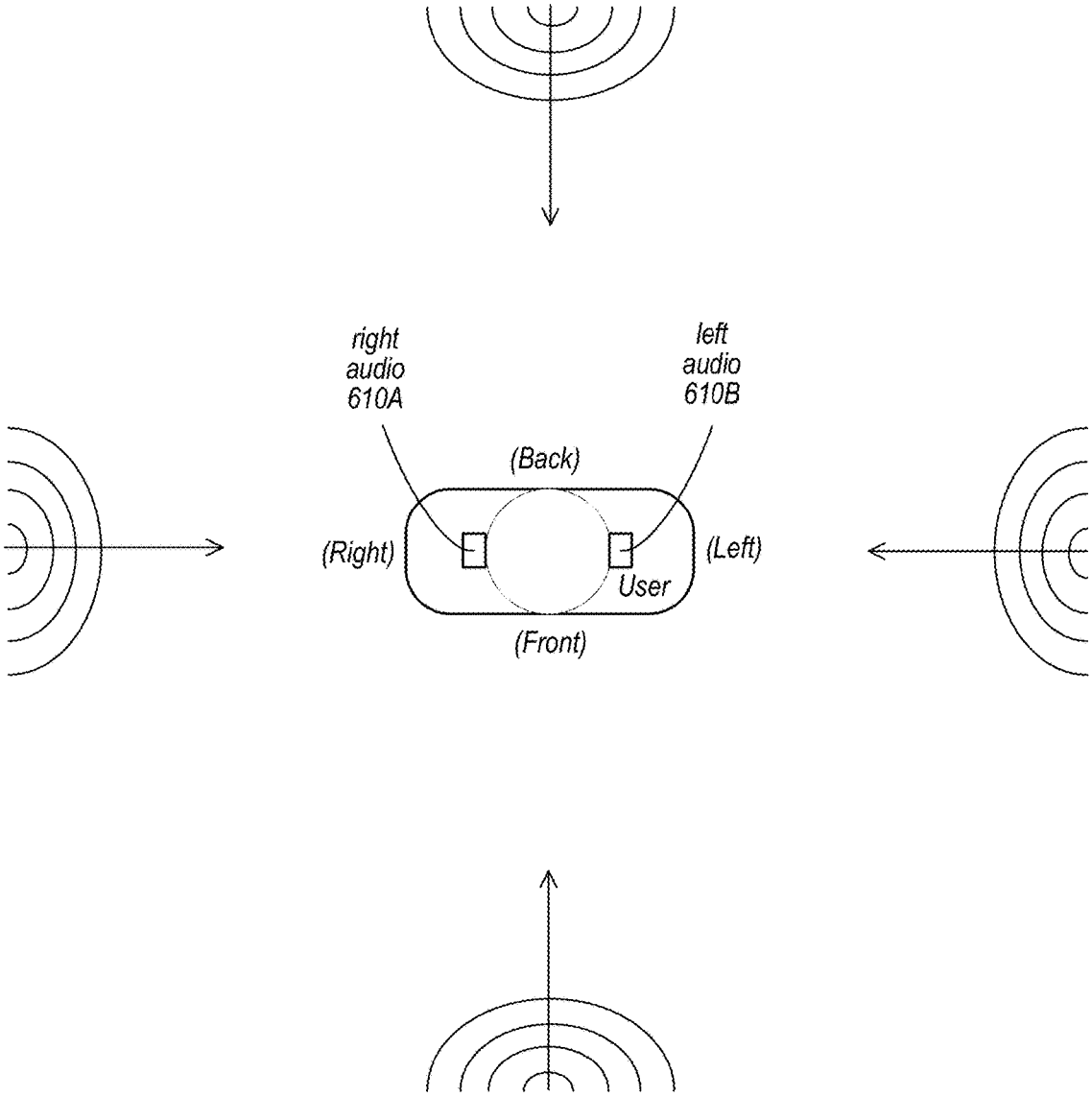
FIGS. 6A and 6B illustrate conventional audio output through a binaural audio device.
Figure 6B:
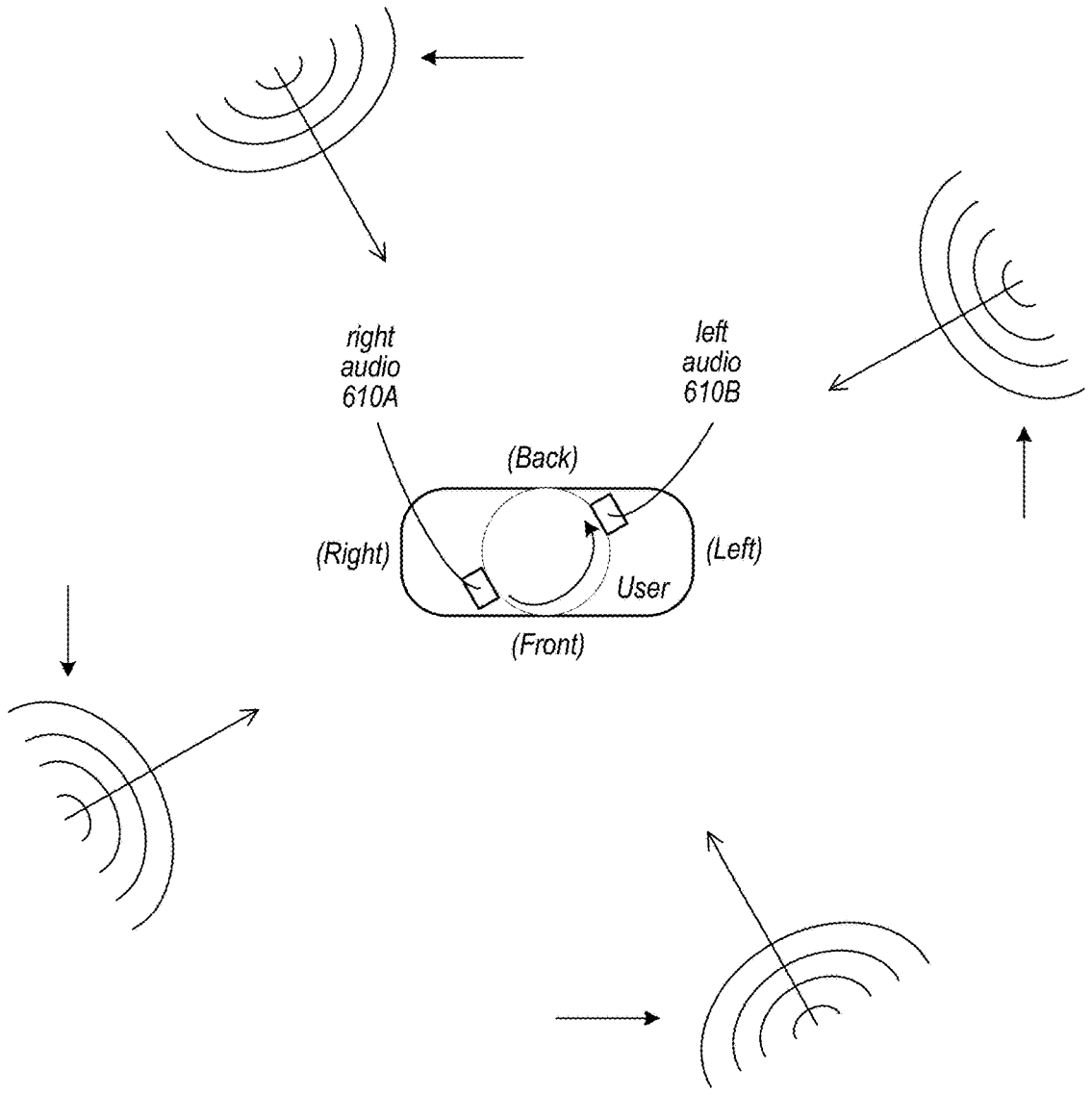

FIGS. 6A and 6B illustrate conventional audio output through a binaural audio device (right 610A and left 610B audio devices such as earbuds or headphones). FIG. 6A shows that the sound may seem to be coming from all around the user, or alternatively from the user's right and left sides. As shown in FIG. 6B, as the user turns their head, in conventional systems, the sound stays in the same relative position to the user's head.

Figure 6C:
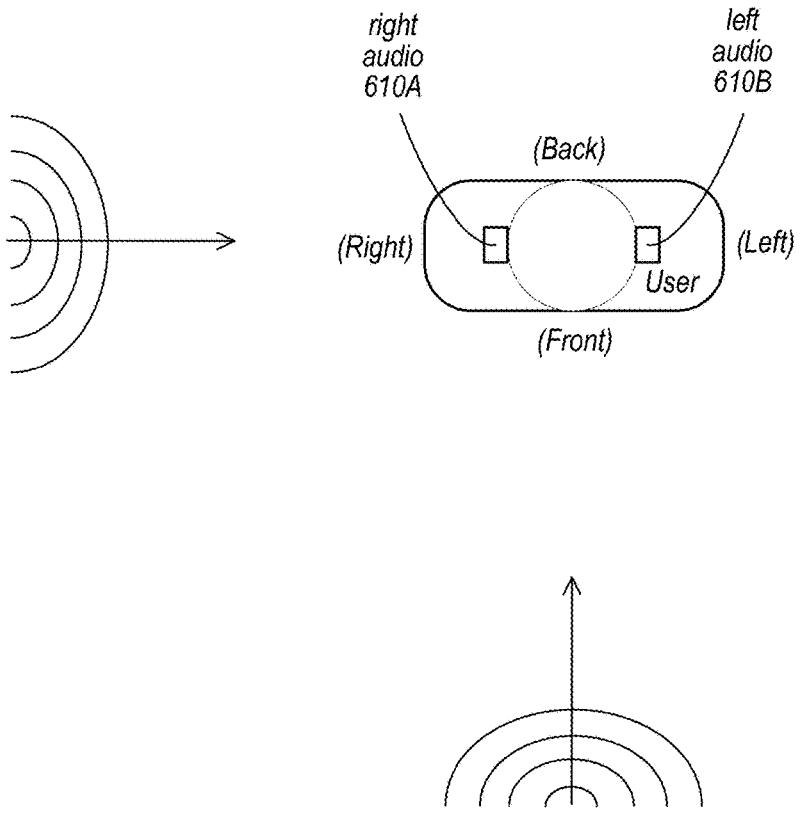
FIGS. 6C and 6D illustrate predictive head-tracked binaural audio rendering, according to some embodiments.
Figure 6D:
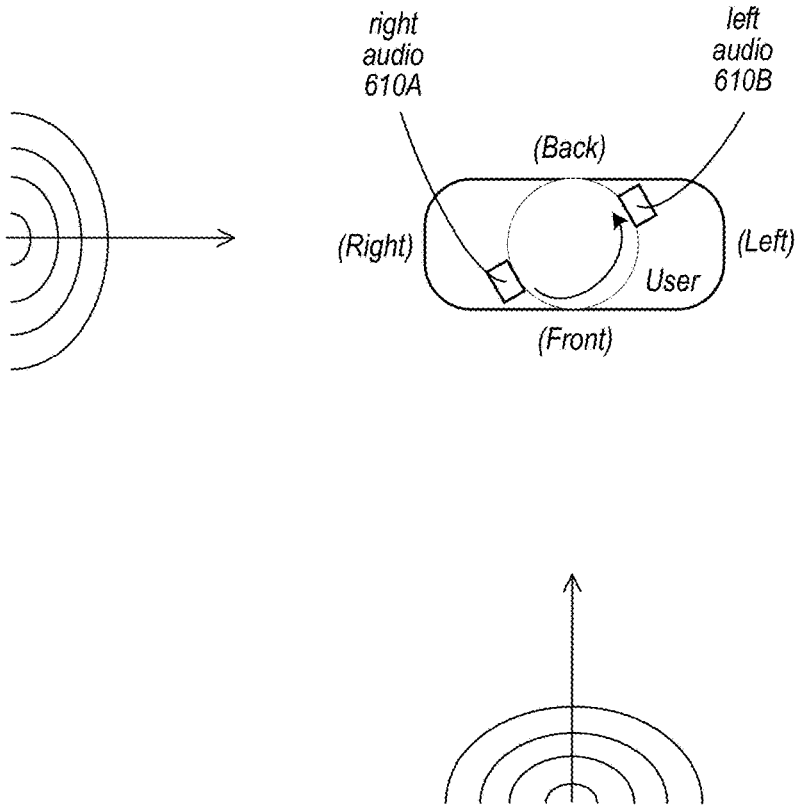

FIGS. 6C and 6D illustrate predictive head-tracked binaural audio rendering, according to some embodiments. As shown in FIG. 6C, the user is looking directly ahead, and one sound seems to the user to be coming from directly in front of the user at some distance, while another sound seems to the user to be coming from the user's right. In FIG. 6D, the user has turned their head to the left, but instead of rotating with the user's head as illustrated in FIG. 6B the direction of the sounds remain fixed in the environment.

Figure 7A:
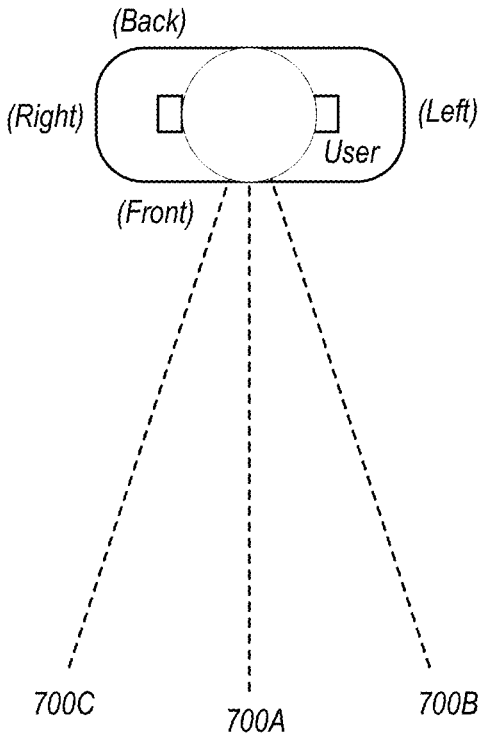
FIGS. 7A and 7B illustrate multiple audio streams rendered for different possible head positions, according to some embodiments.
Figure 7B:
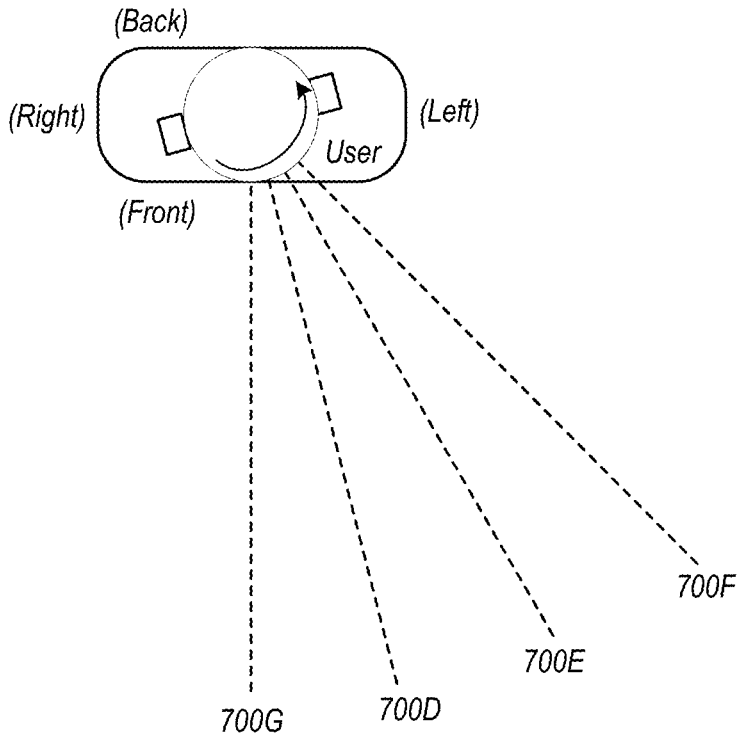

FIGS. 7A and 7B illustrate multiple audio streams rendered for different possible head positions, according to some embodiments. In FIG. 7A, as a non-limiting example, if analysis of the head tracking data received from the headset by the rendering device indicates that the user's head is currently still, the rendering device may render and transmit an audio stream 700A for the known position, an audio stream 700B for a position N (e.g., 5) degrees to the left of the known position, and an audio stream 700C for a position N (e.g., 5) degrees to the right of the known position in case the user turns their head during the time it takes to get the head tracking information to the rendering device, to render the audio, and to transmit the rendered audio to the headset. At the headset, the headset selects and plays the audio stream that is closest to the actual position of the head based on the most recent head tracking data, or alternatively mixes two of the streams if the actual position of the head is between two of the audio streams.

In FIG. 7B, as another example, if analysis of the head tracking data received from the headset by the rendering device indicates that the user's head is turning at a known angular rate, the rendering device 360 may render and transmit an audio stream 700D at the currently known position (in case head movement stops), an audio stream 700E at a position predicted by the known angular rate, and an audio stream 700F at a position predicted at twice the known angular rate. In some embodiments, one or more additional audio streams 700G may be rendered that are behind the currently known position in case the user reverses the rotation of their head. At the headset, the headset selects and plays the audio stream that is closest to the actual position of the head based on the most recent head tracking data, or alternatively mixes two of the streams if the actual position of the head is between two of the audio streams.

Figure 8:
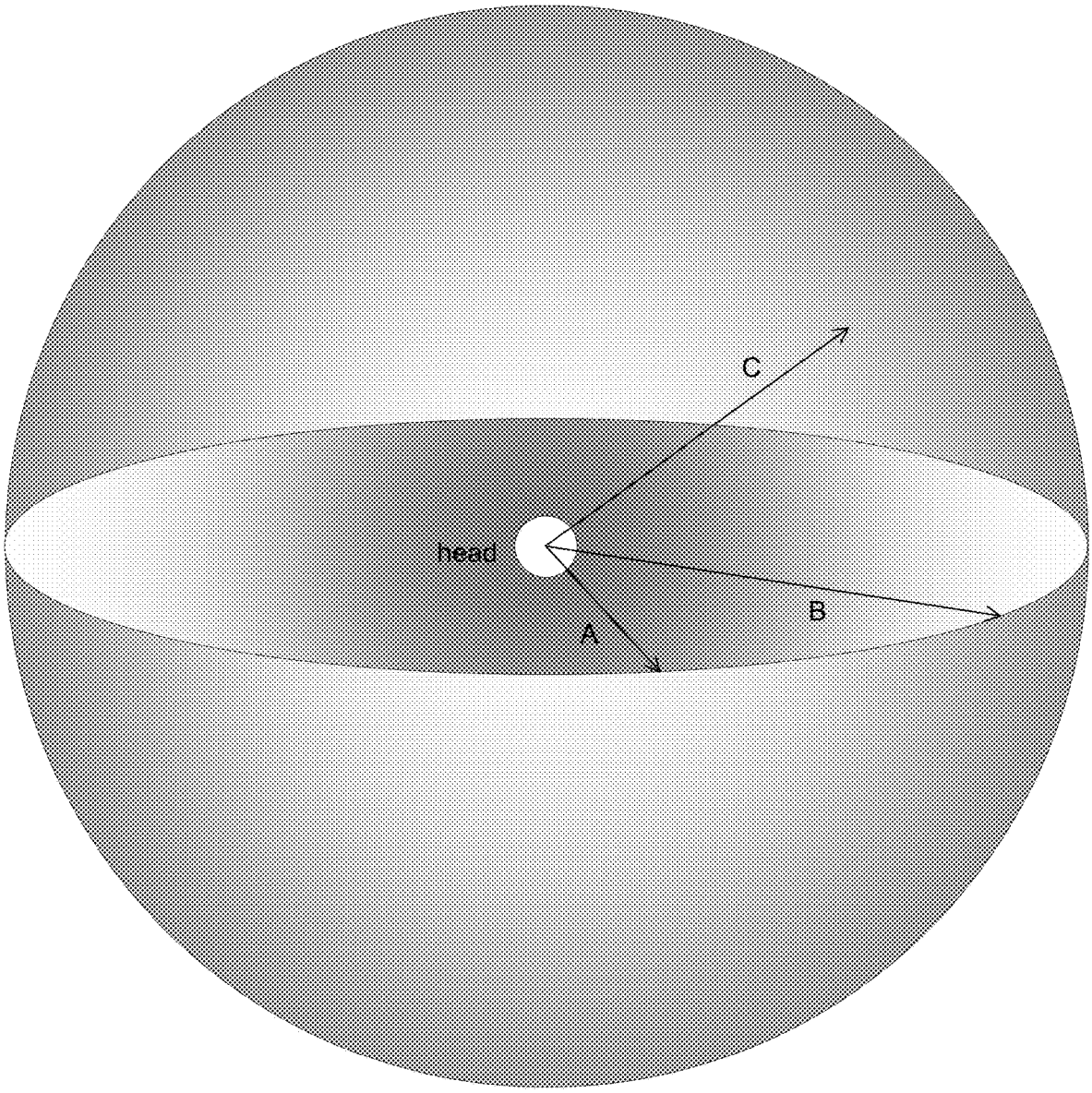
FIG. 8 illustrates providing directionality of sound in multiple dimensions, according to some embodiments.

While embodiments are generally described in which the rendering device renders multiple audio streams and the headset selects one or more audio streams to provide directionality of sound in one dimension (i.e., the horizontal dimension), embodiments may be used to provide directionality of sound in multiple dimensions, for example to provide sounds at azimuth angles, elevation angles, and sounds to indicate translational movements. For example, the base station may render audio streams at multiple positions in the horizontal dimension and also render audio streams above and/or below the horizontal dimension. For example, as illustrated in FIG. 8, the base station may render audio streams at positions A and B in the horizontal dimension and also render an audio stream C above the horizontal dimension. At the headset, the headset selects and plays the audio stream that is closest to the actual position and elevation (or tilt) of the head based on the most recent head tracking data, or alternatively mixes two or more of the streams if the actual position and tilt of the head is somewhere between the audio streams. For example, the headset may select either A, B, or C if the head position is at or near one of those positions, may mix A and B if the head position is between A and B, may mix A and C if the head position is between A and C, may mix B and C if the head position is between B and C, or may mix A, B and C if the head position is somewhere in the middle.

The methods described herein may be implemented in software, hardware, or a combination thereof, in different embodiments. In addition, the order of the blocks of the methods may be changed, and various elements may be added, reordered, combined, omitted, modified, etc. Various modifications and changes may be made as would be obvious to a person skilled in the art having the benefit of this disclosure. The various embodiments described herein are meant to be illustrative and not limiting. Many variations, modifications, additions, and improvements are possible. Accordingly, plural instances may be provided for components described herein as a single instance. Boundaries between various components, operations and data stores are somewhat arbitrary, and particular operations are illustrated in the context of specific illustrative configurations. Other allocations of functionality are envisioned and may fall within the scope of claims that follow. Finally, structures and functionality presented as discrete components in the example configurations may be implemented as a combined structure or component. These and other variations, modifications, additions, and improvements may fall within the scope of embodiments as defined in the claims that follow.

What is claimed is:

1. A system, comprising:

a rendering device configured to communicate with a binaural audio device by a connection, the rendering device comprising:

one or more processors;

one or more receivers configured to receive tracking data from the binaural audio device via the connection, wherein the tracking data is indicative of a position of the binaural audio device;

memory comprising program instructions executable by the one or more processors to:

analyze the tracking data to predict multiple potential positions of the binaural audio device; and render multiple audio streams corresponding to the multiple potential positions of the binaural audio device; and one or more transmitters configured to transmit the multiple audio streams to the binaural audio device via the connection; and wherein the binaural audio device is configured to select and mix two of the multiple audio streams to match an actual current position of the binaural audio device.

2. The system as recited in claim 1, wherein the connection is one of a wireless connection or a wired connection.

3. The system as recited in claim 1, wherein the binaural audio device is configured to select one of the multiple audio streams that best matches an actual current position of the binaural audio device for playback.

4. The system as recited in claim 1, wherein the two of the multiple audio streams are selected based on two of the multiple potential positions that are closest to the actual current position of the binaural audio device.

5. The system as recited in claim 1, wherein the binaural audio device includes one or more motion sensors to track motion of the binaural audio device.

6. The system as recited in claim 1, wherein the multiple audio streams each include left and right audio channels, and wherein, in rendering the multiple audio streams corresponding to the multiple potential positions of the binaural audio device, directionality and distance of virtual sources of sounds with respect to the potential positions of the binaural audio device are controlled by attenuating one or more aspects of the left and right audio channels.

7. The system as recited in claim 1, wherein the binaural audio device is an audio headset or earbuds, and wherein the rendering device is a mobile multipurpose device.

8. The system as recited in claim 1, wherein the binaural audio device is a component of a head-mounted display (HMD) of a virtual reality or mixed reality system, and wherein the rendering device is a base station of the virtual reality or mixed reality system.

9. The system as recited in claim 1, wherein the rendering device is configured to compress the multiple audio streams using a multichannel audio compression technique.

10. A system, comprising:

a binaural audio device comprising:

one or more motion sensors to track motion of the binaural audio device;

one or more processors;

one or more transmitters configured to transmit tracking data collected by the one or more motion sensors to a rendering device via a connection, wherein the tracking data is indicative of a position of the binaural audio device;

one or more receivers configured to receive multiple audio streams from the rendering device via the connection, wherein the multiple audio streams correspond to multiple potential positions of the binaural audio device; and memory comprising program instructions executable by the one or more processors to:

determine an actual position of the binaural audio device based on current tracking data from the motion sensors; and upon determining that the actual position of the binaural audio device does not match the positions of the multiple audio streams, mix two of the multiple audio streams to generate an audio stream that matches the actual position of the binaural audio device.

11. The system as recited in claim 10, wherein the connection is one of a wireless connection or a wired connection.

12. The system as recited in claim 10, wherein the program instructions are executable by the one or more processors to, upon determining that the actual position of the binaural audio device matches the position of one of the multiple audio streams, select the matching audio stream for playback.

13. The system as recited in claim 10, wherein the rendering device comprises:

one or more receivers configured to receive the tracking data from the binaural audio device via the connection;

one or more rendering device processors;

rendering device memory comprising program instructions executable by the one or more rendering device processors to:

analyze the tracking data to predict the multiple potential positions of the binaural audio device; and render the multiple audio streams corresponding to the multiple potential positions of the binaural audio device; and one or more transmitters configured to transmit the multiple audio streams to the binaural audio device via the connection.

14. The system as recited in claim 10, wherein the multiple audio streams each include left and right audio channels, and wherein directionality and distance of virtual sources of sounds with respect to the potential positions of the binaural audio device are controlled by attenuations of one or more aspects of the left and right audio channels.

15. The system as recited in claim 10, wherein the binaural audio device is an audio headset or earbuds, and wherein the rendering device is a mobile multipurpose device.

16. The system as recited in claim 10, wherein the binaural audio device is a component of a head-mounted display (HMD) of a virtual reality or mixed reality system, and wherein the rendering device is a base station of the virtual reality or mixed reality system.

17. A method, comprising:

performing, by a rendering device comprising one or more processors:

receiving head tracking data from a binaural audio device via a connection;

analyzing the head tracking data to predict multiple potential positions of a user's head;

rendering multiple audio streams corresponding to the multiple potential positions of the user's head; and transmitting the multiple audio streams to the binaural audio device via the connection; and performing, by the binaural audio device:

determining an actual position of the user's head; and upon determining that the actual position of the user's head does not match the positions of the multiple audio streams, mixing two of the multiple audio streams to generate an audio stream that matches the actual position of the user's head.

18. The method as recited in claim 17, further comprising performing, by the binaural audio device:

transmitting the head tracking data collected by one or more motion sensors to the rendering device via the connection, wherein the actual position of the user's head is determined based on current head tracking data from the motion sensors;

receiving the multiple audio streams corresponding to the multiple potential positions of the user's head from the rendering device via the connection.

19. The method as recited in claim 17, further comprising, upon determining that the actual position of the user's head matches the position of one of the multiple audio streams, selecting and playing the matching audio stream.

20. The method as recited in claim 17, further comprising compressing the multiple audio streams prior to said transmitting.

* * * * *